US007367466B2

(12) United States Patent
Zhou et al.

(10) Patent No.: US 7,367,466 B2
(45) Date of Patent: May 6, 2008

(54) CORNER FITTING AND CONTAINER USING THE SAME

(75) Inventors: Yuanda Zhou, Shenzhen (CN); Sidong He, Shenzhen (CN)

(73) Assignee: China International Marine Containers (Group) Co., Ltd., Shenzhen (CN)

( * ) Notice: Subject to any disclaimer, the term of this patent is extended or adjusted under 35 U.S.C. 154(b) by 0 days.

(21) Appl. No.: 10/442,896

(22) Filed: May 21, 2003

(65) Prior Publication Data

US 2003/0230587 A1 Dec. 18, 2003

(30) Foreign Application Priority Data

May 24, 2002 (CN) ..... 02 2 27835

(51) Int. Cl.
*B65D 88/02* (2006.01)
*B65D 90/02* (2006.01)

(52) U.S. Cl. ..... 220/1.5; 220/677; 220/678

(58) Field of Classification Search ..... 220/1.5, 220/646, 677, 678, 679, 680
See application file for complete search history.

(56) References Cited

U.S. PATENT DOCUMENTS 3,044,656 A * 7/1962 Dobbie et al. ..... 220/1.5
3,456,830 A * 7/1969 Golder ..... 220/1.5
4,558,797 A * 12/1985 Mitchell ..... 220/1.5
4,593,831 A * 6/1986 Clive-Smith ..... 220/1.5
4,860,918 A * 8/1989 Wuyten et al. ..... 220/1.5
4,964,252 A * 10/1990 Guliker ..... 220/1.5
5,141,122 A * 8/1992 Grogan ..... 220/1.5
5,655,662 A * 8/1997 Garcia ..... 220/1.5
5,671,854 A * 9/1997 Thomas ..... 220/1.5
5,678,715 A * 10/1997 Sjostedt et al. ..... 220/1.5
5,688,086 A * 11/1997 Menzemer et al. ..... 220/1.5
6,279,767 B1 * 8/2001 Yoon ..... 220/1.5
6,811,048 B2 * 11/2004 Lau ..... 220/1.5

FOREIGN PATENT DOCUMENTS

GB 2194511 A * 3/1988 ..... 220/677

* cited by examiner

*Primary Examiner*—Gary E Elkins
(74) *Attorney, Agent, or Firm*—Greer, Burns & Crain, Ltd.

(57) ABSTRACT

A container corner fitting provided at each right angle of a container body and connected with other parts of the container body includes a sealing device arranged thereon including a first flange of a predefined length provided on one of an inner side surface and a top or a bottom surface of the corner fitting. A second flange of a predefined length is provided on the other of the inner side surface and the top or the bottom surface of the corner fitting and aligned with the first flange. The seal gasket, provided with circumstance of the container gate, can depend on the first and second flanges while closing the gate, greatly improving container hermetic performance. The thickness of an upper or a lower horizontal container member can be reduced to approximate that of a top or a bottom container plate, obtaining the largest volume without inclining the bottom plate.

15 Claims, 7 Drawing Sheets

CORNER FITTING AND CONTAINER USING THE SAME

FIELD OF THE INVENTION

The present invention relates to a transport tool, in particular to a container and its improved corner fitting structure.

BACKGROUND OF THE INVENTION

In the structure of a container, a corner fitting is often used to connect with the other members of the container structure to form a complete container body. FIG. 1 is a schematic diagram of a prior art corner fitting 10, which has side surfaces 12, a bottom surface 14, and a top surface 16. The corner fitting 10 utilizes its own surfaces to connect with other members of a container body 20. FIG. 2 is a schematic diagram showing part of the container body 20 connected by corner fittings 10. Upper corner fittings 10*a*, 10*b* are connected with an upper horizontal member 22 of the container body 20 at inner side surfaces 12*a* and 12*b*, and are connected with a corner post 24 of the container body 20 at bottom surfaces 14*a* and 14*b*, while lower corner fittings 10*c* and 10*d* are connected with a lower horizontal member 26 of the container body 20 at inner side surfaces 12*c* and 12*d*, and are connected with the corner post 24 at top surfaces 16*c* and 16*d*. Therefore, the space confined by the upper and lower horizontal members 22 and 26 and the corner post 24 determines the size of the container gate. In practice, it is always desired that the gate size of the container body 20 is as large as possible so as to facilitate loading and unloading. For example, in the prior art container structure, one can try to reduce the thickness of the upper horizontal member 22 or that of the lower horizontal member 26 to approximate the thickness of a top plate 28 or a bottom plate (not shown) of the container body 20. However, when the thickness of the top plate 28 or the bottom plate (not shown) is less than that of the corner fitting 10, sealing of the container cannot be ensured at the inner side of the corner fitting 10. There is a seal gasket on the circumference of the gate of the container body 20. Since no sealing structure is provided at the inner side of the corner fitting 10, the seal gasket provided on the circumference of the gate of the container body 20 has no surface to rest on, resulting in poor sealing of the container body.

SUMMARY OF THE INVENTION

Accordingly, the present invention is directed to a corner fitting with a sealing structure arranged thereon to ensure a good sealing effect for the container body. Another object of the present invention is to provide a goods container having the present corner fitting structure, which can ensure a large-size gate plate design and can prevent damage to the container goods.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a corner fitting for a container provided at each right angle part of a container body and connected with other parts of the container body comprises a sealing device arranged thereon which includes a first flange of a predefined length provided on one of an inner side surface and a top or a bottom surface of the corner fitting. The sealing device of the present invention also contains a second flange of a predefined length provided on the other of the inner side surface and the top or the bottom surface of the corner fitting and aligned with the first flange. The first and second flanges can be further connected with each other at a corner of the corner fitting. The first and second flanges of the present invention are arranged in a center of the inner side surface and the top or the bottom surface, respectively, can extend sidewise to keep flush with the inner side surface and the top or the bottom surface of the corner fitting, respectively, and can further extend to either side of the first or second flange to have a length equal to that of the surface matched with the corner fitting. The first and second flanges have a rectangular or a trapezoidal or an arc-shaped cross-section.

In another aspect of the present invention, a goods container is provided with an upper horizontal member, a lower horizontal member, two corner posts, and a plurality of corner fittings, each corner fitting being connected with the upper and lower horizontal members and two corner posts, respectively, wherein on each corner fitting is arranged a sealing device having a first flange of a predefined length provided on one of the inner side surface and the top or the bottom surface of the corner fitting. The sealing device of the present invention also comprises a second flange of a predefined length provided on the other of the inner side surface and the top or the bottom surface of the corner fitting, the second flange being in alignment with the first flange. The first and second flanges are connected with each other at the corner of the corner fitting. The first and second flanges of the goods container of the present invention are arranged in the center of the inner side surface and the top or the bottom surface, can extend sidewise to keep flush with the inner side surface and the top or the bottom surface of the corner fitting respectively, and can further extend to either side of the first or second flange to have a length equal to that of the surface matched with the corner fitting. The first and second flanges have a rectangular or trapezoidal or an arc-shaped cross-section. Thus, the upper and lower horizontal members of the goods container of the present invention can be arranged at the ends of the first or second flange or on the first or second flange, so that the thickness of the upper and lower horizontal members can be reduced to approximate that of the top plate or the bottom plate, increasing thus the size of the container gate as large as possible.

In a further aspect of the present invention, a corner fitting for a container is provided at each right angle part of the container body and connected with other parts of the container body, and has a sealing device arranged thereon which contains a first flange of a predefined length provided on the inner side surface of the corner fitting; a second flange of a predefined length provided on the top or the bottom surface, and aligned with the first flange. The first and second flanges of the present invention can be arranged in the middle of the inner side surface and the top or the bottom surface of the corner fitting, respectively, and can extend sidewise to keep flush with the inner side surface and the top or the bottom surface of the corner fitting, respectively, and can further extend to either side of the first or second flange to have a length equal to that of the surface matched with the corner fitting. The first and second flanges have a rectangular or trapezoidal or an arc-shaped cross-section.

In a further aspect of the present invention, a goods container comprises an upper horizontal member, a lower horizontal member, two corner posts and a plurality of corner fittings connected with the upper and lower horizontal members and the two corner posts, respectively, wherein on each corner fitting is arranged a sealing device having a first flange of a predefined length provided on the inner side surface, a second flange of a predefined length provided on the top or the bottom surface of the corner fitting and aligned with the first flange. Preferably, the first and second flanges of the goods container of the present invention are arranged in the center of the inner side surface and the top or the bottom surface, can extend sidewise to keep flush with the inner side surface and the top or the bottom surface of the corner fitting, respectively, and can further extend to either side of the first or second flange to have a length equal to that of the surface matched with the corner fitting. Thus, the upper and lower horizontal members of the goods container of the present invention can be arranged at the ends of the first or second flange or on the first or second flange, so that the thickness of the upper and lower horizontal members can be reduced to approximate that of the top plate or the bottom plate, increasing thus the size of the container gate as large as possible.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Figure 1:
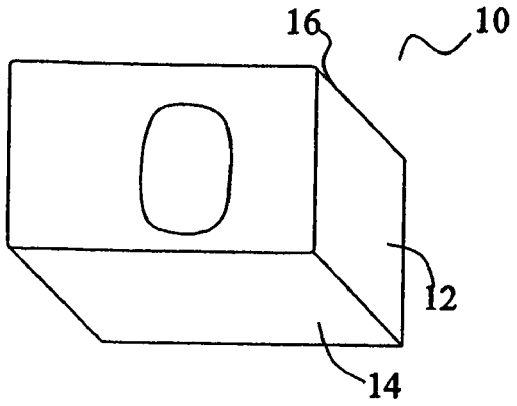
Fig.1 PRIOR ART
FIG. 1 is a perspective view of a corner fitting according to the prior art.
Figure 2:
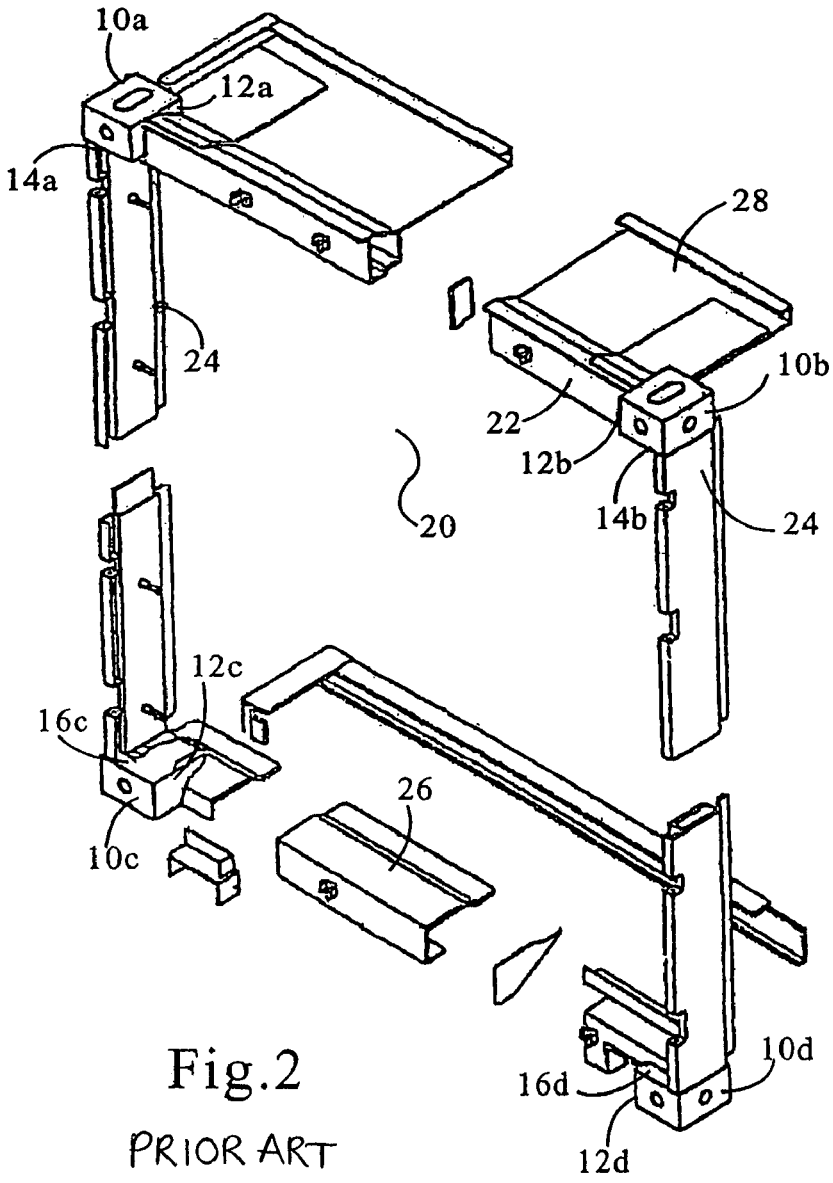
Fig.2 PRIOR ART
FIG. 2 is a schematic diagram showing part of a container body connected with the prior art corner fitting.
Figure 3A:
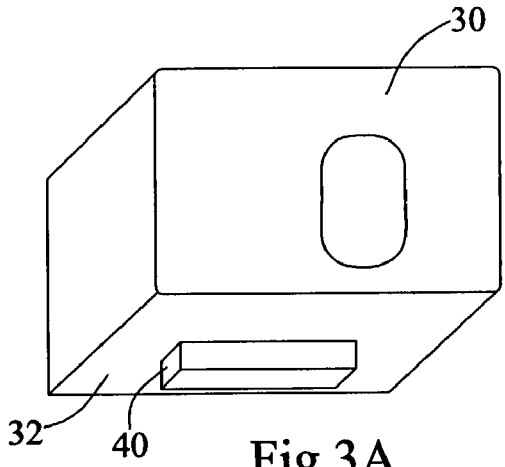
FIG. 3A is a perspective view for a first embodiment of a corner fitting of the present invention with a flange provided on a bottom surface of the corner fitting.
Figure 3B:
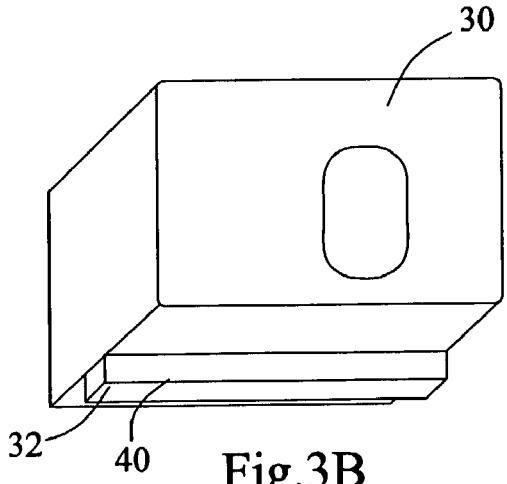
FIG. 3B is a perspective view for a second embodiment of the corner fitting of the present invention with the flange having a length equal to that of the bottom surface.
Figure 3C:
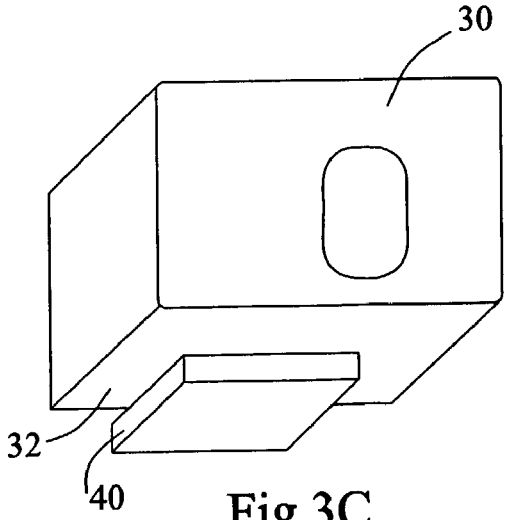
FIG. 3C is a perspective view for a third embodiment of the corner fitting of the present invention with the flange on the bottom surface extending sidewise.

In the present invention, a container body 100 is provided and has a gate plate having four right angle parts. Each of the right angle parts should be provided with a corner fitting 30 as to be a bearing part. The preferred embodiments of the present invention described here utilize a corner fitting 30*a* on an upper left-side of the container gate as an example for illustrations (see FIG. 11). Referring to FIG. 3A, the first embodiment of the present invention is to arrange a sealing device or a bottom flange 40 having a predefined length, on a bottom surface 32 of the corner fitting 30. The bottom flange 40 can also extend sidewise in either horizontal direction towards an inner side surface 34 or an outer side surface (not shown) to have a length equal to that of the bottom surface 32, as is shown in FIG. 3B. Of course, the bottom flange 40 can be arranged at any position on the bottom surface 32 according to the practical design of the container body 100, such as the position shown in FIG. 3A, where the bottom flange is centered on the bottom surface, and can also extend to keep flush with the bottom surface, as is shown in FIG. 3C. It is contemplated that the corner fitting 30 on whose bottom surface the bottom flange 40 is arranged can be provided on the upper left-side 30*a* and an upper right-side 30*b* part of the container body 100.

Figure 3D:
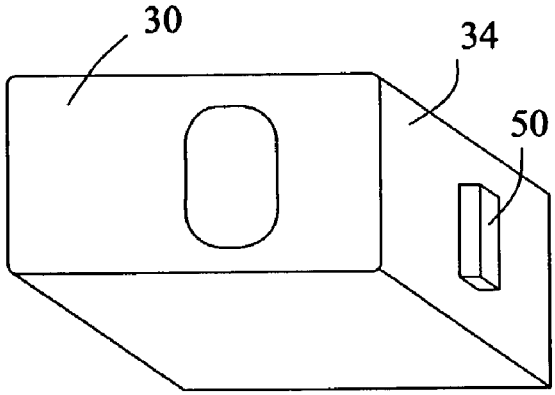
FIG. 3D is a perspective view for a fourth embodiment of the corner fitting of the present invention with the flange provided on an inner side surface of the corner fitting.
Figure 3E:
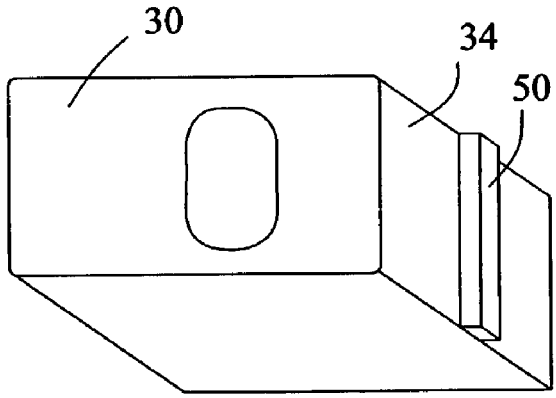
FIG. 3E is a perspective view for a fifth embodiment of the corner fitting of the present invention with the flange having a length equal to that of the inner side surface.
Figure 3F:
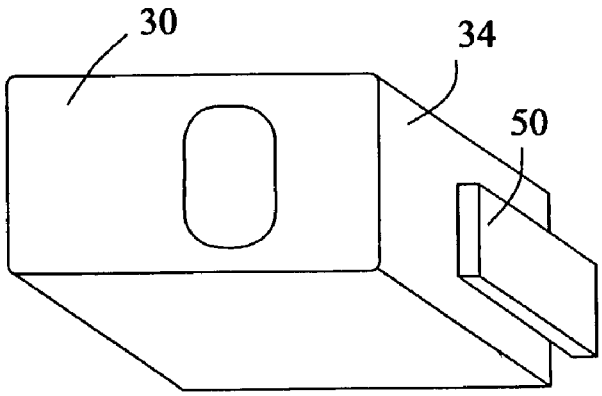
FIG. 3F is a perspective view for a sixth embodiment of the corner fitting of the present invention with the flange on the inner side surface extending sidewise.

According to the present invention, a side flange 50 can also be provided and is arranged on the inner side surface 34 of the corner fitting 30. As shown in FIG. 3D, the side flange 50 having a predefined length is arranged in a center of the inner side surface 34. Of course, the side flange 50 can extend in either vertical direction towards the bottom surface 32 or a top surface (not shown), as is shown in FIG. 3E, to have a length equal to that of the inner side surface 34, and can also extend sidewise to keep flush with the inner side surface 34, as shown in FIG. 3F.

The flange according to the present invention, whether it is provided on the bottom surface 32 or on the inner side surface 34, can butt against the seal gasket (not shown) when the container gate is closed, resulting thus in a very good sealing effect.

Figure 4:
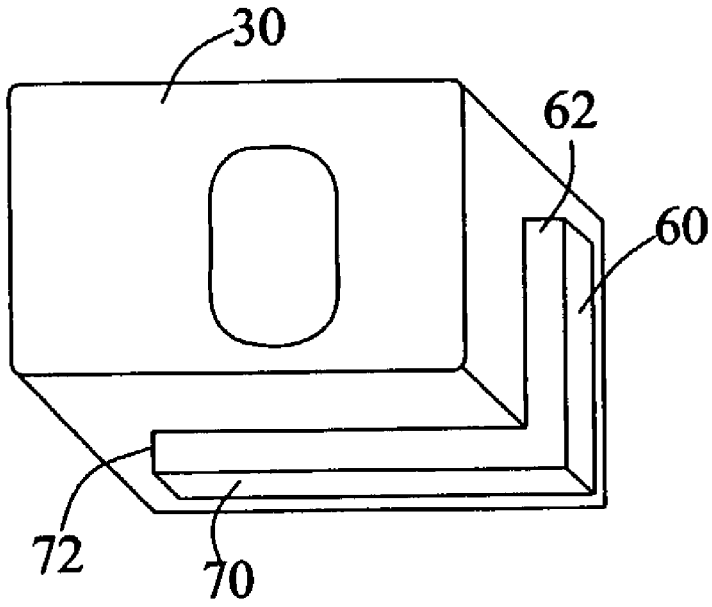
FIG. 4 is a perspective view for a seventh embodiment of the corner fitting of the present invention with the corner fitting provided on an upper left-side part of the container and first and second flanges provided on the inner side surface and bottom surface.

Similarly, to illustrate the more extensive applicability of the technical solution of the present invention, FIG. 4 shows a preferred embodiment of the corner fitting 30 arranged on the upper left-side 30*a* of the container body 100. The sealing devices are a first flange 60 and a second flange 70 arranged simultaneously on the inner side surface 34 and the bottom surface 32, which are kept in alignment with each other and extend separately sidewise to connect with each other at a corner of the corner fitting 30. Thus, the sealing device of the present invention gets in close contact with the gate seal gasket (not shown), resulting in a very good sealing effect. In the preferred embodiment shown in FIG. 4, the sealing device is provided in centers of the inner side surface 34 and the bottom surface 32, respectively, and the first and second flanges 60 and 70 are arranged to be of a predefined length, i.e., a length less than the length of the surface on which the corner fitting 30 is situated. A gap is provided between the ends of the first and second flanges 60, 70, forming thus the container body 100 of the present invention. Referring to the schematic assembly diagram in FIG. 11 and FIG. 4, an upper horizontal member 102 can be arranged at an end 62 of the first flange 60, and a corner post 104 on a left side of the container body 100 can be arranged at an end 72 of the second flange 70.

Figure 5:
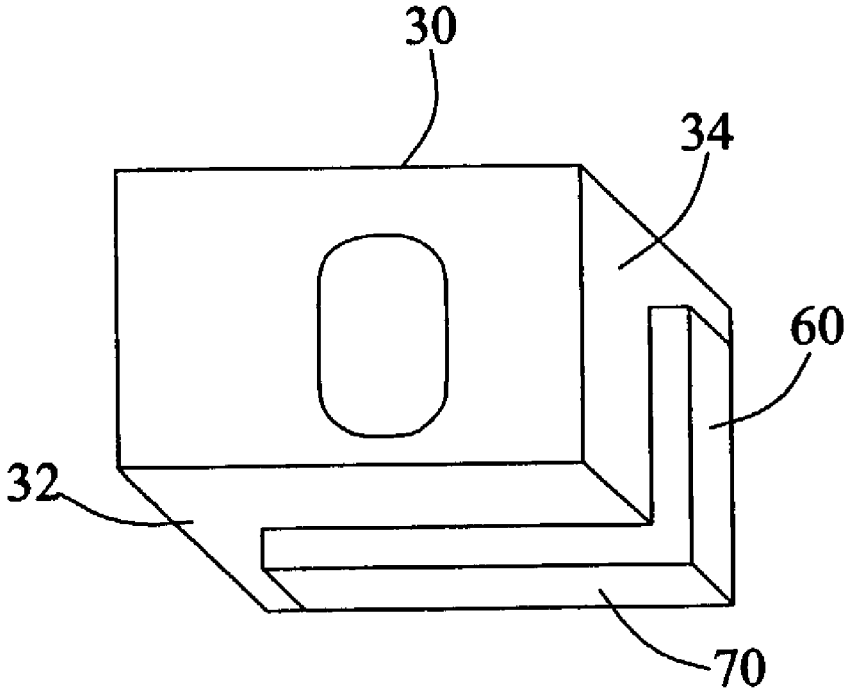
FIGS. 5-6 are the perspective views for an eighth embodiment of the corner fitting of the present invention with the first and second flanges extending sidewise to keep flush with a surface matched with the corner fittings.
Figure 6:
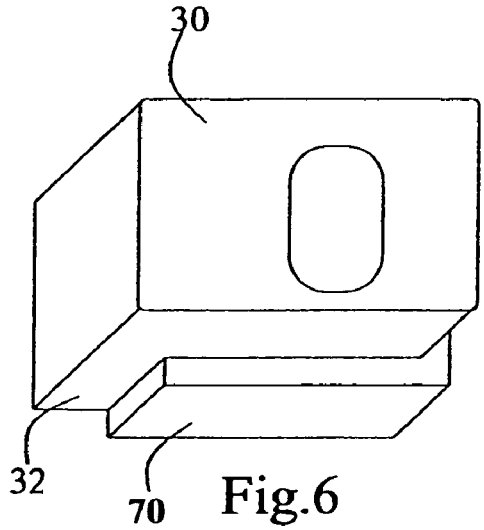

Of course, the first and second flanges 60 and 70 according to the present invention can also extend sidewise to keep flush with the inner side surface 34 and the bottom surface 32, respectively, as is shown in FIG. 5. The lengths of the first and second flanges 60, 70 are shorter than the length of the inner side surface 34 and the length of the bottom surface 32, respectively. As shown in FIG. 6, it is contemplated that the first and second flanges 60, 70 are fixed with the corner fitting 30 through welding.

Figure 7:
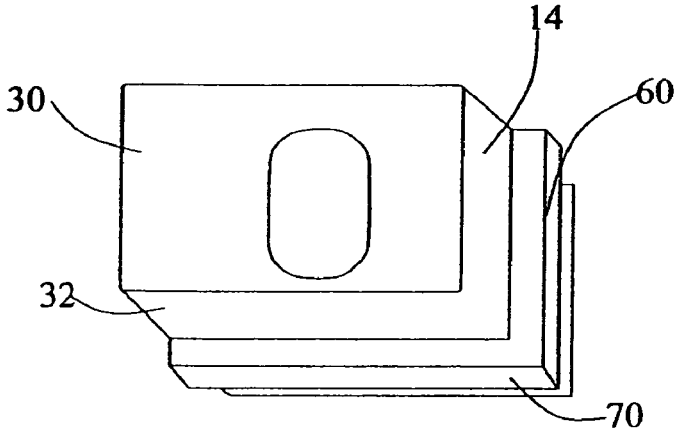
FIGS. 7-8 are the perspective views for a ninth embodiment of the corner fitting of the present invention with the flange on the upper left-side part of the container having a length equal to that of the surface matched with the corner fitting.
Figure 8:
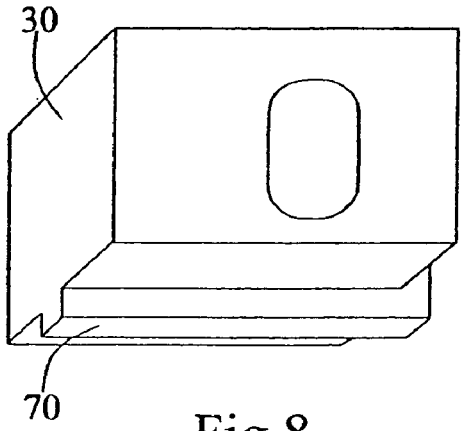
Figure 11:
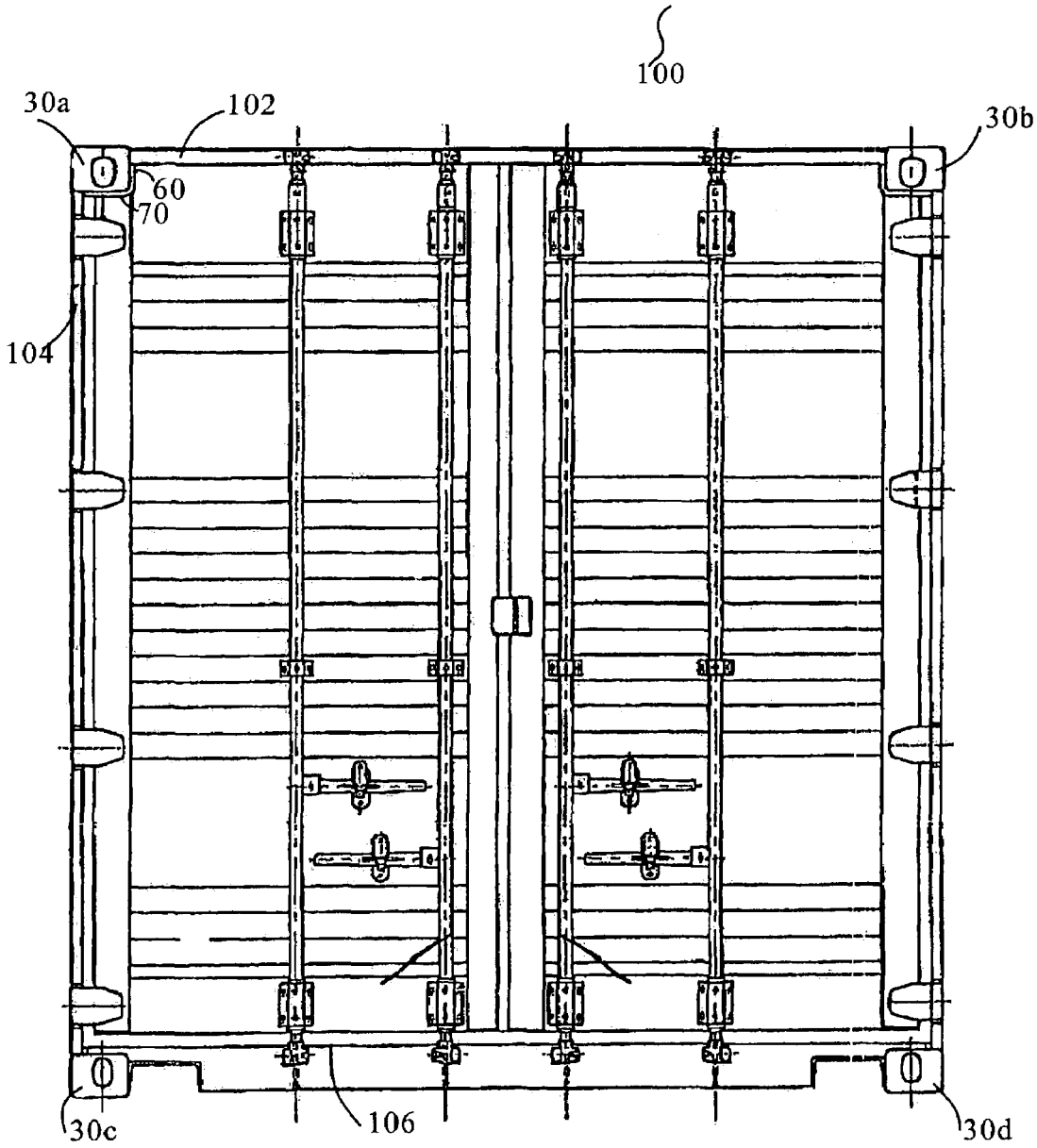
FIG. 11 is a schematic diagram showing the container body connected with the corner fittings of the present invention.

It is shown from the preferred embodiment of FIG. 7 that the first and second flanges 60 and 70 can also extend to their two ends respectively to have a length equal to that of the inner side surface 34 and that of the bottom surface 32. In the container of this embodiment, the upper horizontal member 102 and the left-side corner post 104 as shown in FIG. 11 should be fixed on the first and second flanges 60 and 70. It is contemplated that the first and second flanges 60, 70 can be integrally formed with the corner fitting 30, as is shown in FIG. 8.

Figure 9:
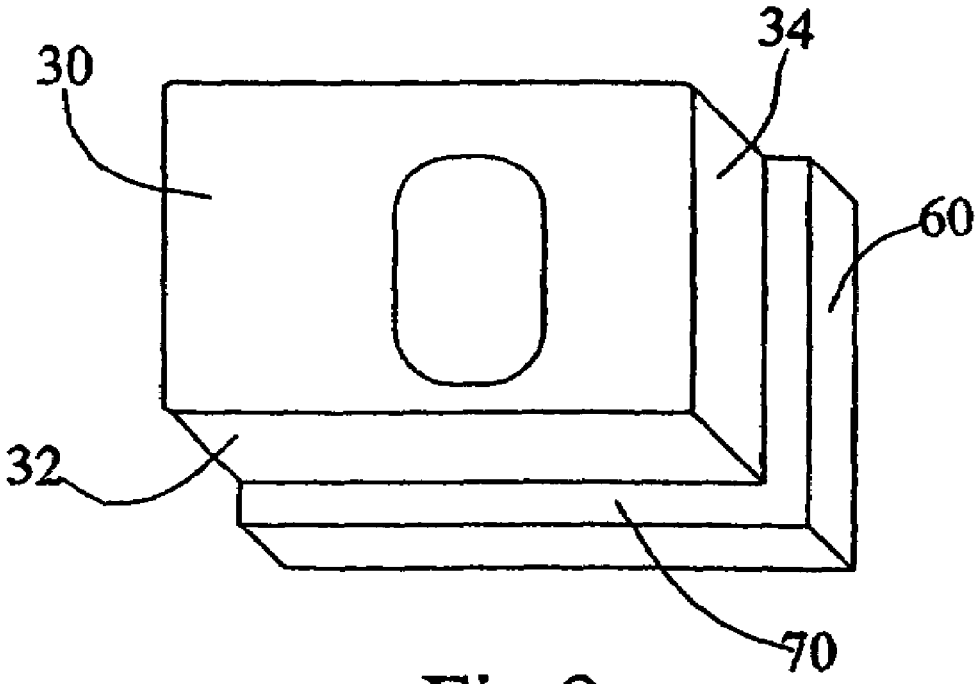
FIGS. 9-10 are the perspective views for a tenth embodiment of the corner fitting of the present invention with the flange extending sidewise and having a length equal to that of the surface matched with its corner fitting.
Figure 10:
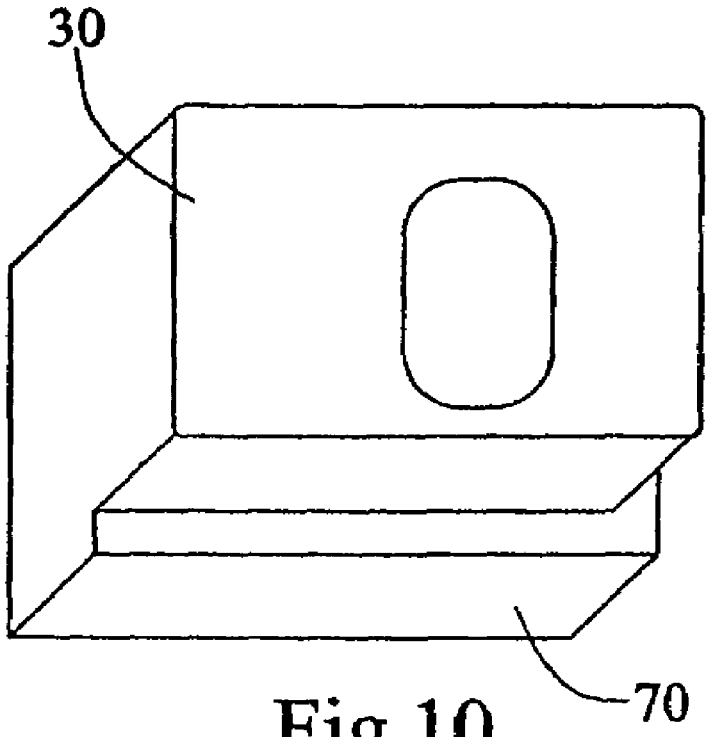

The first and second flanges 60, 70 in FIG. 9 extend sidewise to keep flush with the surface matched with the corner fitting 30, and can also extend fully to either end to have a length equal to that of the surface matched with the corner fitting. Of course, the first and second flanges 60, 70 in this embodiment can be also integrated with the corner fitting 30.

FIG. 11 is a schematic diagram showing the back-view structure of the container body 100 having the corner fittings 30 according to the present invention. The upper horizontal member 102 of the container body 100 can be directly arranged on the ends of the first flange 60 or on the first flange itself using the corner fittings at the four right angle parts of the container. As is shown in the figure, according to the technical solution of the present invention, the first and second flanges 60 and 70 are arranged, with respect to the upper left-side corner fitting 30*a*, and the upper right-side corner fitting 30*b*, on the inner side surface 34 and the bottom surface 32, respectively, while the first and second flanges 60 and 70 are arranged, with respect to a lower left-side corner fitting 30*c* and a lower right-side corner fitting 30*d*, on the inner side surface 32 and the top surface (not shown), respectively. Therefore, the thickness of the lower horizontal member 106 arranged on the first flange end can be reduced to approximate that of the bottom plate of the container body 100, so that the size of the container gate is nearly equal to the inner size of the container body 100, and a larger applicable volume can be obtained without any inclination of the bottom plate of the container body 100.

As described above, the corner fitting 30 of the present invention has the following advantages.

First of all, because of the arrangement of sealing flanges on at least one inner surface of the corner fitting, the seal gasket provided with circumstance of the container gate can depend on the flanges of the present invention while closing the gate, that is, it is defined between the gate and the flanges. Thus the hermetic performance for the container is greatly improved.

Also, through the arrangement of sealing flanges on corner fittings, it is possible to reduce the thickness of the upper or the lower horizontal member to approximate that of the top plate or bottom plate, so that the container gate has a size close to the inner size of the container body, obtaining thus the largest volume without inclining the bottom plate of the container.

While the present invention has been described with reference to preferred embodiments, it is understandable that certain modifications and variations may be made thereto by those who are skilled in the technical field of the present invention without deviating from the spirit of the present invention to facilitate the application of the corner fitting to other transport tools such as the semi-trailer, which needs the arrangement of corner fittings on each angle part as bearing components, or other variations may be made to the sealing device of the present invention such that the cross-section of the flange is made to be of the form of a trapezoid, an arc or other forms without departing from the scope as set forth in the appended claims.

What is claimed is:

1. A corner fitting for a container including a container body, the corner fitting provided on each right angle corner part of the container body and connected with other parts of the container body, wherein said corner fitting comprises an inner side surface, a top surface, a bottom surface and a sealing device, the sealing device including:

a first flange of a predefined length, arranged on one of the inner side surface and the top or the bottom surface of said corner fitting, said first flange having a solid cross-section throughout said first flange, said first flange also having a frontmost face and a rearmost face, wherein said frontmost face of said first flange is substantially perpendicular to at least one of said top surface and said bottom surface; and a second flange of a predefined length, arranged on the other of said inner side surface and said top or bottom surface of the corner fitting, said second flange having a solid cross-section throughout said second flange, said second flange also having a frontmost face and a rearmost face, wherein said frontmost face of said second flange is substantially perpendicular to at least one of said top surface and said bottom surface, and further wherein said frontmost face of said second flange is entirely coplanar with said frontmost face of said first flange, wherein said first and second flanges are arranged in a center of the inner side surface and the top or bottom surface, respectively, and said first and second flanges connect with each other at a corner of said corner fitting formed by said inner side surface and said top or bottom surface.

2. The corner fitting according to claim 1, wherein said first flange has a length less than or equal to that of said inner side surface.

3. The corner fitting according to claim 1, wherein said second flange has a length less than or equal to that of one of said top and bottom surfaces.

4. The corner fitting according to claim 1, wherein each of said first and said second flanges has a rectangular or trapezoidal cross-section.

5. The corner fitting according to claim 1, wherein said first flange and said second flange are both configured and arranged to butt against a seal gasket, thereby creating a seal therebetween.

6. A goods container comprising an upper horizontal member, a lower horizontal member, two corner posts, and a plurality of corner fittings connected with said upper and lower horizontal members and said corner posts, wherein each said corner fitting includes an inner side surface, a top surface and a bottom surface and further comprises:

a first flange of a predefined length projecting perpendicularly from the inner side surface of said corner fitting;

a second flange of a predefined length projecting perpendicularly from the top or bottom surface of said corner fitting and aligned with said first flange;

wherein adjacent ends of said first and second flanges are adjoined to form an "L-shape," and wherein said first flange has a length less than that of said inner side surface.

7. The container according to claim 6, wherein said first flange and said second flange are arranged in a center of the inner side surface and the top or bottom surface of said corner fitting, respectively.

8. A container according to claim 7, wherein said first flange and said second flange extend sidewise to keep flush with the inner side surface and the top/bottom surfaces of said corner fitting respectively.

9. The container according to claim 6, wherein said first flange includes a first flange end, and one of said upper and said lower horizontal members is arranged on said first flange of each of said corner fittings.

10. The container according to claim 6, wherein said second flange has a length less than that of said top or bottom surface.

11. The container according to claim 10, wherein said second flange of each of said corner fittings includes a second flange end, wherein each of said two corner posts of said container body is provided at said second flange ends of two of said corner fittings.

12. The container according to claim 6, wherein said second flange has a length equal to that of said top or bottom surface.

13. The container according to claim 12, wherein one of said corner posts of said container body is provided on the second flange of each of said corner fittings.

14. A goods container comprising an upper horizontal member, a lower horizontal member, two corner posts, and a plurality of corner fittings connected with said upper and lower horizontal members and said corner posts, wherein each said corner fitting includes an inner side surface, a top surface and a bottom surface and further comprises:

a first flange of a predefined length projecting perpendicularly from the inner side surface of said corner fitting;

a second flange of a predefined length projecting perpendicularly from the top or bottom surface of said corner fitting and aligned with said first flange;

wherein adjacent ends of said first and second flanges are adjoined to form an "L-shape," and wherein said first flange has a length equal to that of said inner side surface.

15. The container according to claim 14, wherein one of the upper and lower horizontal members are arranged on said first flange of each of said corner fittings.

* * * * *